United States Patent [19]

Hanold

[11] 4,017,937

[45] Apr. 19, 1977

[54] HOSE COUPLING FOR A SUCTION CLEANER

[75] Inventor: William E. Hanold, Bloomington, Ill.

[73] Assignee: National Union Electric Corporation, Greenwich, Conn.

[22] Filed: May 14, 1975

[21] Appl. No.: 577,284

[52] U.S. Cl. ..... 15/327 R; 285/7; 285/88; 285/319; 285/376; 285/423

[51] Int. Cl.[2] ..... A47L 5/00; A47L 9/24

[58] Field of Search ..... 285/7, 319, 376, 360, 285/361, 401, 88, 402, 317, 423; 15/327 R, 327 F, 327 A, 327 B, 327 C, 327 D, 327 E

[56] References Cited

UNITED STATES PATENTS

| | | | |
|---|---|---|---|
| 813,792 | 2/1906 | Gooch et al. | 285/360 X |
| 1,146,822 | 7/1915 | Tapani | 285/361 X |
| 2,660,457 | 11/1953 | Mallon | 285/402 X |
| 3,168,382 | 2/1965 | Chambers et al. | 285/319 X |
| 3,381,328 | 5/1968 | Szabo | 285/7 X |
| 3,722,927 | 3/1973 | Miska | 285/7 X |
| 3,874,024 | 4/1975 | Ford | 285/7 X |

*Primary Examiner*—Dave W. Arola
*Attorney, Agent, or Firm*—Hibben, Noyes & Bicknell, Ltd.

[57] ABSTRACT

A hose coupling for detachably connecting one end of a cleaning tool hose to the suction inlet of a suction cleaner. The coupling includes a female coupling portion comprising a pair of circumferentially spaced, diametrically arranged flange portions on the margin of the suction inlet, and a male coupling portion comprising diametrically-spaced lug means on the end of the hose. The lug means are axially shiftable through recesses in the flange portions when the end of the hose is positioned for initial insertion into the inlet. After initial insertion, the end of the hose is rotated through a predetermined number of degrees to a locked, operative position in the inlet. A spring biased detent holds the end of the hose in its locked operative position, and a manually actuated push-button permits a user to disengage the detent from a receiving notch in one of the flange portions so that the end of the hose can be rotated to its initial insertion position and then withdrawn axially from the suction inlet.

8 Claims, 8 Drawing Figures

HOSE COUPLING FOR A SUCTION CLEANER

This invention relates to suction cleaners, and more particularly relates to a hose coupling construction for detachably connecting a cleaning tool hose to the suction opening of a suction cleaner.

Many types of hose couplings have been heretofore developed for releasably connecting or coupling one end of a cleaning tool hose to the suction opening of a suction cleaner so that suction is conducted through the hose to an associated cleaning tool attached to the opposite end of the hose. The Osborn U.S. Pat. No. 2,487,470 and the Smithson U.S. Pat. No. 3,149,362 are examples of hose connectors or couplings which perform this function and which utilize some form of U-shaped, spring member to retain the male portion of the coupling engaged with the female portion after the male portion is inserted into the female portion. In both the Osborn and Smithson patents, disengagement of the male portion of the coupling from the female portion is effected by rotating the male portion in either direction from a latched position, thereby causing the spring member to move out of a retaining recess in the outer periphery of the male portion of the coupling so that the latter can be withdrawn from the female portion.

While hose couplings of the character disclosed in the aforementioned Osborn and Smithson U.S. patents have proved generally satisfactory for their intended purpose, difficulties were sometimes experienced with such couplings due to accidental or unintentional disengagement of the male and female portions of such couplings while the cleaners were in use. Moreover, suction losses sometimes developed as a result of wear in the recesses or grooves which received the retaining spring member.

Hose or pipe coupling arrangements have also been developed for connecting one end of a suction pipe or hose extension to the suction inlet of a suction cleaner, wherein a plurality of circumferentially spaced, radially shiftable pins or lugs were mounted on the male portion of the coupling, the pins being movable through alignment slots or grooves in the margin of the suction inlet and engageable with inclined cam surfaces on the inner surface of the female portion of the coupling. The cam surfaces effected additional axial movement of the male portion into the female portion as the male portion was rotated to compress a seal member and thus prevent suction loss when the parts were coupled. An example of the foregoing type of coupling arrangement is disclosed in the Meyerhoefer U.S. Pat. No. 2,912,261.

While the coupling construction of the Meyerhoefer U.S. Pat. No. 2,912,261 provided a positive connection between the male and female portions of the coupling, such construction was objectionable from the standpoint that considerable effort had to be exerted by the user to effect engagement and disengagement of the coupling portions.

Accordingly, it is a general object of the present invention to provide an improved hose coupling for connecting one end of a cleaning tool hose to the suction inlet of a suction cleaner, which is not subject to the aforementioned disadvantages of the prior art.

Another object is to provide a novel hose coupling of the foregoing character, wherein the male portion of the coupling may be rapidly and easily engaged with or disengaged from the female portion.

A more particular object is to provide a novel hose coupling of the foregoing character, wherein a spring-biased catch is provided for releasably locking the male coupling portion in the female coupling portion and wherein the male coupling portion must be rotated a predetermined number of degrees in the female coupling portion before the coupling portions become locked together.

Still another object is to provide a novel hose coupling of the foregoing character, wherein a push button on the male coupling portion must be depressed before the coupling portions can be disengaged after they have been locked together by the catch.

A further object is to provide a novel hose coupling of the character described, which is simple in construction, rapid and positive in operation, and economical to manufacture.

These and other objects will become apparent from the following detailed description and accompanying sheet of drawings, wherein.

Figures 1, 2, 3, 4, 5, 6, 7, 8:
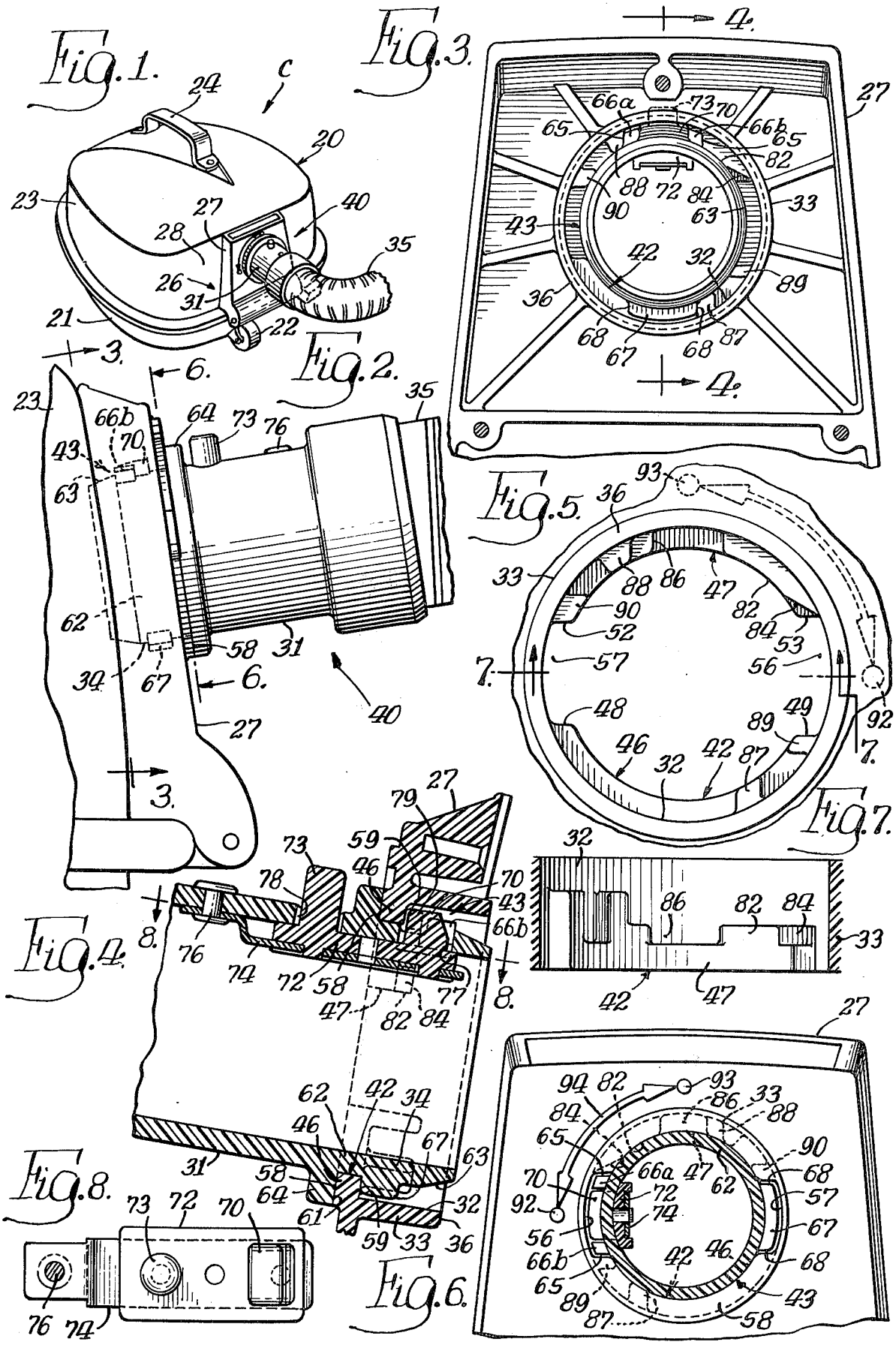
FIG. 1 is a perspective view, on a reduced scale, of a canister type suction cleaner employing a hose coupling embodying the features of the present invention for detachably connecting one end of a cleaning tool hose to the suction opening of the cleaner.
FIG. 2 is a fragmentary, side elevational view of the hose coupling and a portion of the cleaner illustrated in FIG. 1.
FIG. 3 is an elevational view, taken substantially along the line 3—3 of FIG. 2.
FIG. 4 is a somewhat enlarged, fragmentary vertical sectional view taken substantially along the line 4—4 of FIG. 3.
FIG. 5 is a somewhat enlarged, fragmentary elevational view of the female portion of the hose coupling illustrated in FIG. 3.
FIG. 6 is a fragmentary, sectional view taken substantially along the line 6—6 of FIG. 2, but with the male portion of the coupling in the position it would occupy when initially inserted into the female portion.
FIG. 7 is a fragmentary sectional view of the female portion of the coupling, taken substantially along the line 7—7 of FIG. 5, and showing additional details thereof.
FIG. 8 is a transverse sectional view of the catch portion of the coupling and taken substantially along the line 8—8 of FIG. 4.

In FIG. 1, a suction cleaner, in the present instance a canister type suction cleaner C, is illustrated. The cleaner C includes a casing 20 comprising a lower casing section 21 mounted on wheels 22, only one of which is shown in FIG. 1, and an upper casing section or cover 23 having a carrying handle 24. The casing sections 21 and 23 are hingedly connected by a hinge structure, indicated generally at 26, which includes a generally rectangularly-shaped housing 27 secured to an end wall, indicated at 28, of the upper casing section 23 and overlying an opening (not shown) in the end wall 28. The inner surface, indicated at 32 in FIGS. 3–7, inclusive, of a tubular portion 33 of the housing 27, defines a suction opening 32 for the cleaner C. The opening 32 is adapted to receive a portion of one end of a cleaning tool hose, indicated generally at 35. Specifically, the opening 32 is adapted to receive the outer end portion, indicated at 34, of a tubular fitting 31 secured to one end of the hose 35.

The axially inner end, indicated at 36, of the tubular portion 33 engages a filter bag support structure (not shown) mounted on the lower casing section 21, the support structure forming an airtight seal between the tubular portion 33 and the interior of a filter bag (also not shown) mounted on the support structure. A motor-driven suction fan (not shown) in the casing 20 serves as a source of suction at the opening 32 when the cleaner is in operation.

When the cleaner C is to be stored or when it is necessary to swing the upper casing section 23 away from the lower casing section 21 to replace a filter bag, or for some other purpose, it is desirable to disengage the hose 35 from the casing 20. To this end, coupling means embodying the features of the present invention and indicated generally at 40, are provided for detachably connecting the outer end portion 34 of the fitting 31 in the suction opening 32.

Referring now to FIGS. 3–7, inclusive, in connection with FIG. 1, it will be seen that the coupling means 40 includes a female coupling portion, indicated generally at 42 in FIGS. 3–7, inclusive, on the tubular portion 33 of the housing 27, and a male coupling portion, indicated generally at 43 in FIGS. 2, 3, 4 and 6, carried on the outer end portion 34 of the fitting 31.

The female coupling portion 42 comprises flange means including at least one and preferably a pair of circumferentially spaced, radially inwardly extending flange portions 46 and 47 on the inner surface 32 of the tubular portion 33 and adjacent the axially outer end thereof. The circumferential ends, indicated at 48 and 49 in FIGS. 3 and 5, of the flange portion 46 are spaced from the circumferential ends, indicated at 52 and 53, of the flange portion 47 to define a pair of diametrically spaced recesses or gaps 56 and 57 therebetween. The recesses 56 and 57 are sized to closely fit but accommodate free passage of lug means, to be hereinafter described in detail, on the male coupling portion 43. The axially outer and inner surfaces, indicated at 58 and 59 in FIG. 4, of the flange portions 46 and 47, respectively, comprise bearing surfaces on the flange means, the surface 58 also comprising a seal surface.

As will be apparent from FIGS. 2, 3, 4 and 6, the male coupling portion 43 includes a cylindrical section 62 (FIG. 2) having an outside diameter somewhat less than the distance between the radially inner peripheries of the flange portions 46 and 47 so that the section 62 is freely axially and rotatively shiftable between the flange portions 46 and 47. To facilitate insertion of the end portion 34 of the fitting 31 into the suction opening 32, the remote outer end of the end portion 34 is preferably tapered, as at 63. Axially inward movement of the end portion 34 into the suction opening 32 is limited by a radially outwardly extending, circumferential flange 64 around the outer periphery of the fitting 31, the flange 64 being spaced axially inwardly from the cylindrical section 62 and having a combined annular bearing and seal surface 61 (FIG. 4) thereon for engaging the bearing and seal surface 58 on the flange portions 46 and 47.

As heretofore mentioned, the male coupling portion 43 includes lug means in the form of at least one and preferably a pair of diametrically spaced lugs on the cylindrical section 62 of the coupling portion 43. In the present instance, the lug on the upper side of the section 62, as viewed in FIGS. 2 and 3, is in two, circumferentially spaced parts or portions identified at **66*a* and 66*b*, respectively, in FIGS. 3 and 6. The distance between the transverse outer surfaces, indicated at 65 in FIGS. 3 and 6, of the lug parts 66*a* and 66*b* is substantially equal to the width of the recess 56 of the female coupling portion 42. The lug on the lower side of the section 62 is indicated at 67 in FIGS. 2, 3, 4 and 6, and the distance between the transverse outer surfaces, indicated at 68, of the lug 67 is substantially equal to the width of the recess 57**.

In order to assure the proper indexing of the male coupling portion 43 with the female coupling portion 42 during initial engagement of these parts, the widths of the recesses 56 and 57 are different. In the present instance, the recess 56 is wider than the recess 57. In FIG. 6, the lug parts **66*a*–66*b* and lug 67 are shown positioned in their respective recesses 56 and 57 in the positions they would occupy when the male coupling portion 43 is initially inserted into the female coupling portion 42. The lug parts 66*a* and 66*b* will not pass through the recess 57**.

After the end portion 34 of the fitting 31 has been inserted into the suction opening 32 until the flange 64 engages the outer bearing surfaces 58 of the flanges 46 and 47, as shown in FIGS. 2, 4 and 6, the fitting 31 may be rotated in a clockwise direction from the position thereof shown in FIG. 6 to the position thereof shown in FIGS. 1–4, inclusive. To this end, the lug parts **66*a*–66*b* and lug 67 are positioned on the tubular section 62 so that the axially inner end faces of the lug means will move across the inner, axial bearing surfaces 59 of the flange portions 46 and 47. This relationship is best seen in FIG. 4**.

In order to lock the male coupling portion 43 in its operative position in the female coupling portion 42, as shown in FIGS. 1–4, inclusive, catch means is provided. Such catch means comprises a radially shiftable detent 70 which, in the present instance, is preferably disposed between and closely adjacent to the lug parts **66*a* and 66*b*. The detent 70 is preferably formed integrally with and located at one end of a generally rectangular-shaped base member 72, although it could be a separate piece. An upstanding cylindrical section 73 is also provided on the other end of the base member 72 and comprises a push button 73 for effecting radially inward movement of the detent 70. The base member 72 is connected to one end of a flexible arm 74, which is preferably of spring steel, the arm being secured in the fitting 31 as by a rivet 76. Openings 77 and 78 (FIG. 4) are provided in the end portion 34 to accommodate the detent 70 and push button 73**.

As will be apparent from FIG. 4, a portion 79 of the detent 70 extends axially rearwardly beyond or axially overlaps the axial rear faces of the lug parts **66*a* and 66*b* so as to be in axial alignment with a circumferentially extending surface portion, indicated at 82 in FIGS. 3–7, inclusive, of the flange portion 47 when the male coupling portion 43 is fully engaged with the female coupling portion 42. Thus, after the end portion 34 of the fitting 31 is fully axially inserted into the suction opening 32 of the housing 27, as illustrated in FIG. 6, the portion 79 of the detent 70 will engage the surface portion 82 of the flange portion 47 when the fitting 31 is rotated in a clockwise direction from its initially inserted position shown in FIG. 6 to its locked position shown in FIGS. 1–4, inclusive. To this end, radially inward movement of the detent 70 in the male coupling portion 43, as the fitting 31 rotates, is facilitated by cam means on the flange portion 47. As best seen in FIGS. 5 and 7, such cam means preferably comprises an inclined surface 84 adjacent the end 53 of the flange portion 47 and extending between the inner surface 32 of the tubular portion 33 and the circumferentially extending surface portion 82 of the flange portion 47. Thus, as the fitting 31 starts to rotate, the portion 79 of the detent 70 contacts the cam surface 84 and causes the detent 70 to shift radially inwardly and to remain depressed as the detent moves along the surface portion 82**.

As the fitting 31 moves into its operative position illustrated in FIGS. 1–4, inclusive, the detent 70 moves radially outwardly under the biasing force of the flexible spring steel mounting arm 74 into a recess or notch 86 (FIGS. 5, 6 and 7) in the flange portion 47. When seated in the recess 86, the detent 70 prevents rotation of the male coupling portion 43 relative to the female coupling portion 42 and thus prevents disengagement of the coupling parts. In this regard, continued clockwise rotation of the fitting 31, as viewed in FIGS. 1 and 6, at the time the detent 70 seats in its recess 86, is also prevented by an axially extending lug 87 (FIGS. 3, 5 and 6) on the inner surface 32 of the tubular portion 33, the lug 87 acting as a stop for and being engaged by the lug 67 on the male coupling portion 43. Another axially extending lug 88 on the flange portion 47 acts as a stop for and is engaged by the lug part 66*a*, in the same manner as the lug 87.

An axially extending lug 89 adjacent the end 49 of the flange portion 46 and another axially extending lug 90 adjacent the end 52 of the flange portion 47 prevent rotation of the fitting 31 in a counter-clockwise direction, as viewed in FIG. 6, after initial insertion of the end portion 34 into the suction opening 32.

When it is desired to uncouple the fitting 31, and consequently the hose 35, from the housing 27, it is only necessary for a user of the cleaner C to manually depress the push button 73 to cause the detent 70 to move radially inwardly out of the recess 86 a sufficient distance so that the fitting 31 can be rotated in a counter-clockwise direction from the position thereof shown in FIG. 1 to the position shown in FIG. 6. In this regard, as soon as the outer end of the detent 70 has moved onto the surface portion 82 of the flange portion 47, the push button 73 can be released. When the fitting 31 reaches its FIG. 6 position, the lug parts 66*a*, 66*b* and lug 67 are in axial alignment with the recesses 56 and 57. Consequently, the fitting 31 can be removed from the housing by withdrawing the same axially outwardly.

In order to clarify the directions and extent of rotation of the fitting 31 with respect to the housing 27 between its initially inserted and operative, locked positions, indicia in the form of a pair of angularly spaced, cylindrical bosses 92 and 93 are provided on the outer surface of the housing 27, the bosses 92 and 93 being joined by an arcuate double-ended arrow 94. The angle through which the fitting 31 of the hose 35 rotates in the suction opening 32 is about 90 degrees.

The operation of the hose coupling means 40 may be summarized as follows:

Assuming that the fitting 31, and thus the hose 35, are disengaged from the inlet or suction opening 32 in the housing 27 of the canister cleaner C and that a user of the cleaner desires to engage the hose therewith to perform a cleaning operation, coupling of one end of the hose 35 with the suction opening 32 is initiated by aligning the divided lug parts 66*a* and 66*b* and the lug 67 of the male coupling portion 43 with the recesses or gaps 56 and 57 between the flange portions 46 and 47 at the entrance of the tubular portion 33 of the housing 27. The outer end portion 34 of the fitting 31 is then shifted axially inwardly until the collar 64 engages the outer bearing surfaces 58 of the flange portions 46 and 47.

When the end 34 of the fitting 31 is fully axially inserted into the housing 27, the fitting 31 is rotated in a clockwise direction through an angle of approximately 90°. As the fitting 31 rotates, the detent 70 between the lug parts 66*a* and 66*b* shifts radially inwardly as a result of the cam action of the inclined cam surface 84 (FIG. 5). The detent 70 remains in a radially inwardly deflected position as the fitting 31 rotates in the opening 32 until the latter reaches its normal operating or locked position illustrated in FIGS. 1, 3 and 4. At this time, the detent 70 snaps into the recess or notch 86 (FIGS. 5 and 7) in the flange portion 47 under the force of the spring arm 74 on which the base member 72 is mounted, thereby interlocking the fitting 31 in the housing 27. The fitting 31 will remain positively interlocked with the housing 27 due to the overlapped position of the lugs parts 66*a*, 66*b* and the lug 67 with their flange portions 47 and 46, respectively.

When a user desires to disconnect the hose 35 from the housing 27, it is only necessary to momentarily depress the push button 73 a sufficient amount to cause the detent 70 to move radially inwardly out of its receiving recess or notch 86, and then rotate the fitting 31 in a counter-clockwise direction, as viewed in FIG. 1, while holding the push button depressed. Depression of the push button 73 effects radial inward movement of the detent 70 since the push button 73 and detent 70 are formed integrally on the elongated, base member 72, which is mounted in the fitting 31.

After the fitting 31 has been rotated a sufficient amount to cause the detent 70 to engage the radially inner surface portion 82 of the flange portion 47, the push button 73 may be released for the remainder of its angular displacement before reaching the position thereof illustrated in FIG. 6. When the fitting 31 reaches the position shown in FIG. 6, it may be readily withdrawn from the housing 27 since the lug parts 66*a* and 66*b* and lug 67 are then aligned with the recesses 56 and 57, as they were at the time of initial engagement of the end portion 34 of the fitting with the suction opening 32 in the housing 27.

From the foregoing it will be apparent that the hose coupling 40 herein described provides a rigid and positive interconnection of one end of an accessory tool hose with the suction opening of a suction cleaner, such that the hose will not be easily disengaged from the cleaner by accidental bumping or jarring once the connection has been made. In addition, the hose coupling construction of the present invention prevents loss of suction at the junction of the coupling parts and permits rapid disengagement of the cleaning tool hose from the suction opening of the cleaner when it is desired to do so.

I claim:

1. In a suction cleaner including a casing having suction generating means therein and a wall having a suction opening for receiving a portion of one end of a cleaning tool hose, the opposite end of said hose being adapted to receive different types of cleaning tools, the improvement of coupling means for effecting rapid and positive coupling and uncoupling of said one end portion of said hose with said suction opening, said coupling means comprising a female coupling portion carried by said casing and a male coupling portion on the outer end of a fitting secured on one end of said hose, said female coupling portion including flange means extending radially inwardly into said suction opening and having axially inner and outer bearing surfaces, said flange means also having at least one recess in the periphery thereof, said male coupling portion including at least one radially outwardly extending lug, said lug being shiftable through said recess and movable into engagement with said inner bearing surface of said flange means to prevent disengagement of said male coupling portion from said suction opening when said male coupling portion is in a locked position, said fitting also having a collar on the outer periphery thereof and spaced axially from said lug, said collar extending radially outwardly from said fitting and having a combined annular bearing and sealing surface for engaging the axially outer bearing surface of said flange means and limiting axially inward movement of said male coupling portion into said suction opening so that said lug can be moved into engagement with said inner bearing surface of said flange means, catch means carried by said male coupling portion for engaging said female coupling portion and holding said male coupling portion in an operative, locked position in said suction opening, and manually actuated means on said fitting for releasing said catch means so that said male coupling portion can be disengaged from said opening.

2. The suction cleaner of claim 1, in which another lug is provided on said male coupling portion, said lugs are substantially diametrically arranged on said male coupling portion, another recess is provided in the periphery of said flange means, said other recess dividing said flange means into two circumferentially spaced flange portions having axially inner and outer bearing surfaces, and said other recess is sized to closely fit but accommodate free movement of said other lug therethrough.

3. In a suction cleaner including a casing having suction generating means therein and a wall having a suction opening for receiving one end of a cleaning tool hose, the opposite end of said hose being adapted to receive different types of cleaning tools, the improvement of coupling means for effecting rapid and positive coupling and uncoupling of said one end of said hose with said suction opening, said coupling means comprising flange means extending radially inwardly into said suction opening and having axially inner and outer bearing surfaces, radially outwardly extending lug means including a pair of circumferentially spaced lug parts on said end of said hose, said flange means having at least one recess therein accommodating passage of said lug means therethrough, and catch means for releasably retaining said one end of said hose in an operative, locked position in said suction opening, said one end of said hose and at least one of said bearing surfaces being in sealed engagement when said one end of said hose is in said locked position, said catch means including a radially shiftably mounted detent in said one end of said hose and positioned between and closely adjacent to said lug parts, said inner bearing surface of said flange means having a notch for receiving said detent, spring means biasing said detent radially outwardly and into said notch when said end of said hose is in said locked position, and manually actuated means for releasing said catch means so that said end of said hose can be disengaged from said opening.

4. The suction cleaner of claim 3, in which said manually actuated means comprises a depressible push button spaced axially outwardly from said detent and accessible to a user when said one end of said hose is in its operative, locked position in said opening.

5. The suction cleaner of claim 3, in which said flange means has a radially inner bearing surface extending between said recess and said notch, and said spring means biases said detent into engagement with said radially inner bearing surface and said notch when said one end of said hose is rotated a predetermined number of degrees after said lug means has passed through said recess.

6. The suction cleaner of claim 5, in which the angle through which said one end of said hose must rotate before said detent moves into said notch is about 90°.

7. The suction cleaner of claim 5, in which cam means is provided to facilitate movement of said detent onto said radially inner bearing surface.

8. The suction cleaner of claim 7, in which the wall of said casing has a tubular portion defining said suction opening, said flange means is carried on the inner surface of said tubular portion, and said cam means comprises an inclined surface extending between the inner surface of said tubular portion and the radially inner bearing surface of said flange means.

* * * * *